US011085676B2

(12) United States Patent
Creason

(10) Patent No.: US 11,085,676 B2
(45) **Date of Patent: *Aug. 10, 2021**

(54) COMPRESSOR PROTECTION AGAINST LIQUID SLUG

(71) Applicant: Rheem Manufacturing Company, Atlanta, GA (US)

(72) Inventor: Mark O. Creason, Fort Smith, AR (US)

(73) Assignee: Rheem Manufacturing Company, Atlanta, GA (US)

( * ) Notice: Subject to any disclaimer, the term of this patent is extended or adjusted under 35 U.S.C. 154(b) by 91 days.

This patent is subject to a terminal disclaimer.

(21) Appl. No.: 16/442,220

(22) Filed: Jun. 14, 2019

(65) Prior Publication Data

US 2019/0360733 A1 Nov. 28, 2019

Related U.S. Application Data

(63) Continuation of application No. 15/849,174, filed on Dec. 20, 2017, now Pat. No. 10,330,362.

(51) Int. Cl.

| | |
|---|---|
| ***F25B 43/00*** | (2006.01) |
| ***F04B 49/10*** | (2006.01) |
| ***F25B 31/00*** | (2006.01) |
| ***F25B 49/00*** | (2006.01) |

(Continued)

(52) U.S. Cl.

CPC ..... *F25B 43/006* (2013.01); *F04B 39/0005* (2013.01); *F04B 39/0027* (2013.01); *F04B 39/123* (2013.01); *F04B 49/10* (2013.01); *F25B 31/004* (2013.01); *F25B 49/005* (2013.01); *F25B 2400/07* (2013.01); *F25B 2500/03* (2013.01); *F25B 2500/06* (2013.01); *F25B 2500/28* (2013.01)

(58) Field of Classification Search

CPC .... F25B 49/005; F25B 43/006; F25B 31/004; F25B 2500/03; F25B 2500/28; F25B 2500/06

See application file for complete search history.

(56) References Cited

U.S. PATENT DOCUMENTS 3,175,342 A * 3/1965 Balogh ..... F25B 43/003 96/132
3,201,950 A * 8/1965 Shrader ..... F25B 41/20 62/197

(Continued)

*Primary Examiner* — Kun Kai Ma
(74) *Attorney, Agent, or Firm* — Troutman Pepper Hamilton Sanders LLP

(57) ABSTRACT

A liquid slug protector device for air conditioning and heat pump systems includes a housing having an inlet port, an outlet port, and a cavity. The device further includes a piston disposed in the cavity. The piston has an inflow channel. The device also includes a backing structure disposed in the cavity. The backing structure has an outflow channel, where a first refrigerant flow path from the inlet port to the outlet port includes the inflow channel and the outflow channel. The device further includes a peripheral channel that is at least partially bound by the piston. A second refrigerant flow path from the inlet port to the outlet port includes the peripheral channel and the outflow channel. The second refrigerant flow path is closed when the piston abuts against the backing structure.

20 Claims, 10 Drawing Sheets

(51) Int. Cl.
*F04B 39/12* (2006.01)
*F04B 39/00* (2006.01)

(56) References Cited

U.S. PATENT DOCUMENTS 3,370,440 A * 2/1968 Kellie ..... F25B 43/006 62/503
3,443,367 A * 5/1969 Bottum ..... F25B 43/003 96/136
3,626,977 A * 12/1971 Riley ..... F16K 15/028 137/516.25
4,089,667 A * 5/1978 Jonsson ..... F25B 29/003 62/238.6
4,199,955 A * 4/1980 Jonsson ..... F25B 29/003 165/133
4,227,901 A * 10/1980 Lange ..... B01D 15/00 96/133
4,231,230 A * 11/1980 Gratzer ..... F17C 1/00 138/26
4,255,940 A * 3/1981 Grahl ..... F25B 43/003 62/324.3
4,364,756 A * 12/1982 Clarke ..... B01D 46/10 210/282
4,811,571 A * 3/1989 Mayer ..... F25B 43/003 210/DIG. 6
5,050,401 A * 9/1991 Van Steenburgh, Jr. ..... F25B 45/00 62/292
5,058,395 A * 10/1991 Ni ..... F25B 41/20 62/278
5,211,025 A * 5/1993 Ni ..... F25B 43/006 62/129
5,275,537 A * 1/1994 Gasser ..... F04B 35/045 417/48
5,402,655 A * 4/1995 Mangyo ..... F04B 39/16 62/474
6,293,125 B1 * 9/2001 Cole ..... F25B 43/003 210/446
6,367,283 B1 * 4/2002 Enderle ..... F25B 41/062 62/511
9,982,926 B2 * 5/2018 Lee ..... F25B 43/02
2002/0083733 A1 * 7/2002 Zhang ..... F28D 7/04 62/503
2009/0183520 A1 * 7/2009 Yukimoto ..... F25B 41/31 62/222
2011/0173936 A1 * 7/2011 Burns ..... B01D 46/12 55/411
2015/0276286 A1 * 10/2015 Jin ..... F25B 41/31 236/99 R
2015/0354876 A1 * 12/2015 Jin ..... F25B 41/31 236/99 J
2016/0281725 A1 * 9/2016 Matheidas ..... F04D 29/5846

* cited by examiner

COMPRESSOR PROTECTION AGAINST LIQUID SLUG

CROSS REFERENCE TO RELATED APPLICATIONS

The present application is a continuation application of and claims priority to U.S. Nonprovisional patent application Ser. No. 15/849,174, filed Dec. 20, 2017 and titled "Compressor Protection Against Liquid Slug," the entire content of which is incorporated herein by reference.

TECHNICAL FIELD

The present disclosure relates generally to air conditioning and heat pump systems, and more particularly to the protection of compressors of such systems against liquid refrigerant slug.

BACKGROUND

In general, compressors used in air conditioning systems and heat pump systems are designed to compress vapor refrigerant. In view of the incompressibility of liquids by compressors, it is generally desirable to prevent a liquid refrigerant from reaching a compressor. In some cases, an accumulator may be used in the refrigerant path to the compressor to prevent a refrigerant from reaching the compressor in a liquid form. For example, refrigerant that is in liquid form may be in an accumulator under some operating conditions, such as low temperature conditions, and when the system is has been idle for a long time. To avoid liquid refrigerant slug from reaching the compressor, the liquid refrigerant that accumulates in the accumulator is slowly transferred to the compressor, for example, through a relatively small orifice of the accumulator. In some cases, the slow transfer of the refrigerant from the accumulator to the compressor may be an undesirably long process. Thus, a solution that reduces the risk of damage to a compressor from liquid refrigerant without requiring a long wait time may be desirable.

BRIEF DESCRIPTION OF THE DRAWINGS

Reference will now be made to the accompanying drawings, which are not necessarily drawn to scale, and wherein.

Figure 1A:
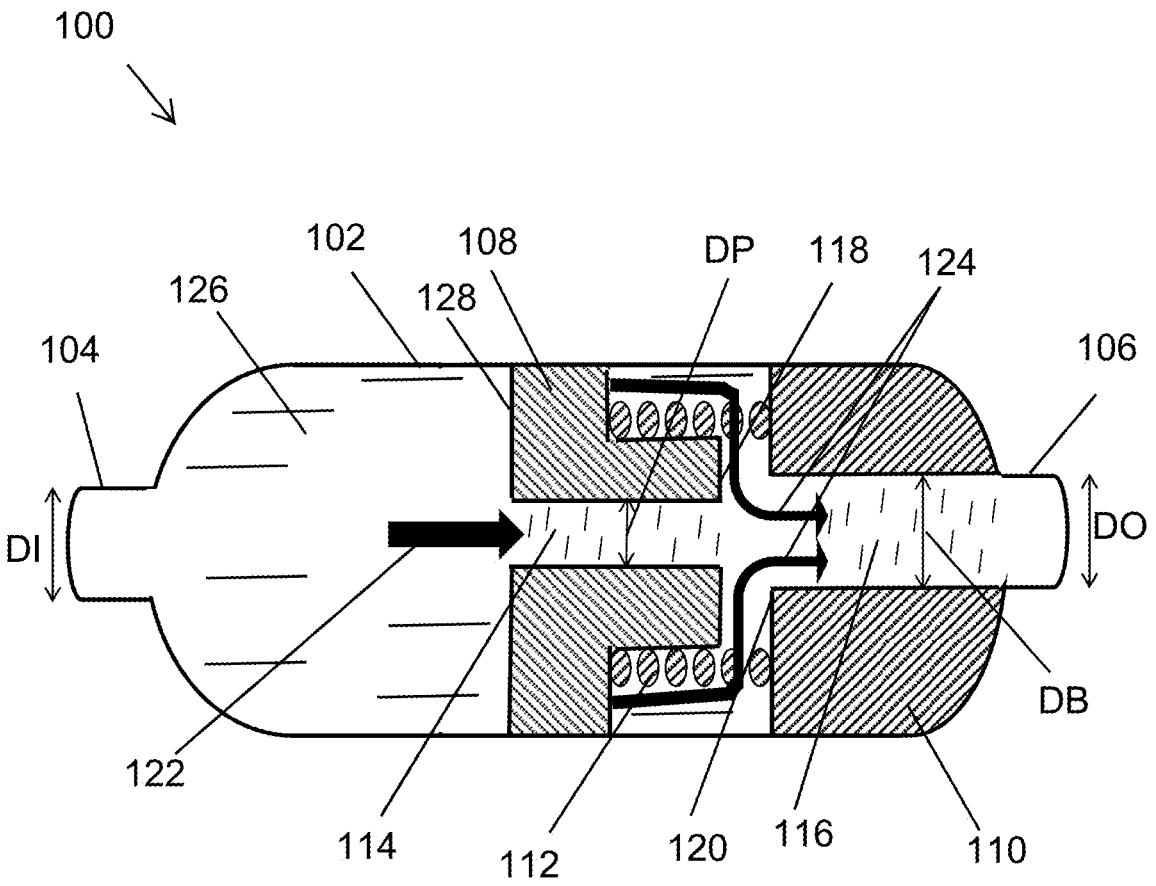
FIG. 1A illustrates a cross-sectional view of a liquid slug protection device according to an example embodiment.

The drawings illustrate only example embodiments and are therefore not to be considered limiting in scope. The elements and features shown in the drawings are not necessarily to scale, emphasis instead being placed upon clearly illustrating the principles of the example embodiments. Additionally, certain dimensions or placements may be exaggerated to help visually convey such principles. In the drawings, the same reference numerals that are used in different drawings designate like or corresponding, but not necessarily identical elements.

SUMMARY

The present disclosure relates generally to air conditioning and heat pump systems, and more particularly to the protection of compressors of such systems against liquid refrigerant slug. In some example embodiments, a liquid slug protector device for air conditioning and heat pump systems includes a housing having an inlet port, an outlet port, and a cavity and a piston disposed in the cavity. The piston has an inflow channel. The device further includes a backing structure disposed in the cavity. The backing structure has an outflow channel, where a first refrigerant flow path from the inlet port to the outlet port includes the inflow channel and the outflow channel. The device also includes a peripheral channel that is at least partially bound by the piston. A second refrigerant flow path from the inlet port to the outlet port includes the peripheral channel and the outflow channel. The second refrigerant flow path is closed when the piston abuts against the backing structure.

In another example embodiment, an air conditioning system includes an evaporator coil, a compressor, and a liquid slug protector device. A refrigerant flows from the evaporator coil to the compressor through the liquid slug protector device. The liquid slug protector device includes a housing having an inlet port, an outlet port, and a cavity. The liquid slug protector device further includes a piston disposed in the cavity. The piston has an inflow channel. The liquid slug protector device also includes a backing structure disposed in the cavity, where the backing structure has an outflow channel. A first refrigerant flow path from the inlet port to the outlet port includes the inflow channel and the outflow channel. The liquid slug protector device further includes a peripheral channel that is at least partially bound by the piston, where a second refrigerant flow path from the inlet port to the outlet port includes the peripheral channel and the outflow channel. The second refrigerant flow path is closed when the piston abuts against the backing structure.

In another example embodiment, a heat pump system includes an indoor coil, an outdoor coil, a compressor, a reversing valve, and a liquid slug protector device. A refrigerant flows from the indoor coil or from the outdoor coil to the compressor through the liquid slug protector device. The liquid slug protector device includes a housing having an inlet port, an outlet port, and a cavity. The liquid slug protector device further includes a piston disposed in the cavity. The piston has an inflow channel. The liquid slug protector device also includes a backing structure disposed in the cavity. The backing structure has an outflow channel, where a first refrigerant flow path from the inlet port to the outlet port includes the inflow channel and the outflow channel. The liquid slug protector device further includes a peripheral channel that is at least partially bound by the piston, where a second refrigerant flow path from the inlet port to the outlet port includes the peripheral channel and the outflow channel. The second refrigerant flow path is closed when the piston abuts against the backing structure.

These and other aspects, objects, features, and embodiments will be apparent from the following description and the appended claims.

DETAILED DESCRIPTION OF EXAMPLE EMBODIMENTS

In the following paragraphs, example embodiments will be described in further detail with reference to the figures. In the description, well-known components, methods, and/or processing techniques are omitted or briefly described. Furthermore, reference to various feature(s) of the embodiments is not to suggest that all embodiments must include the referenced feature(s).

Figure 1B:
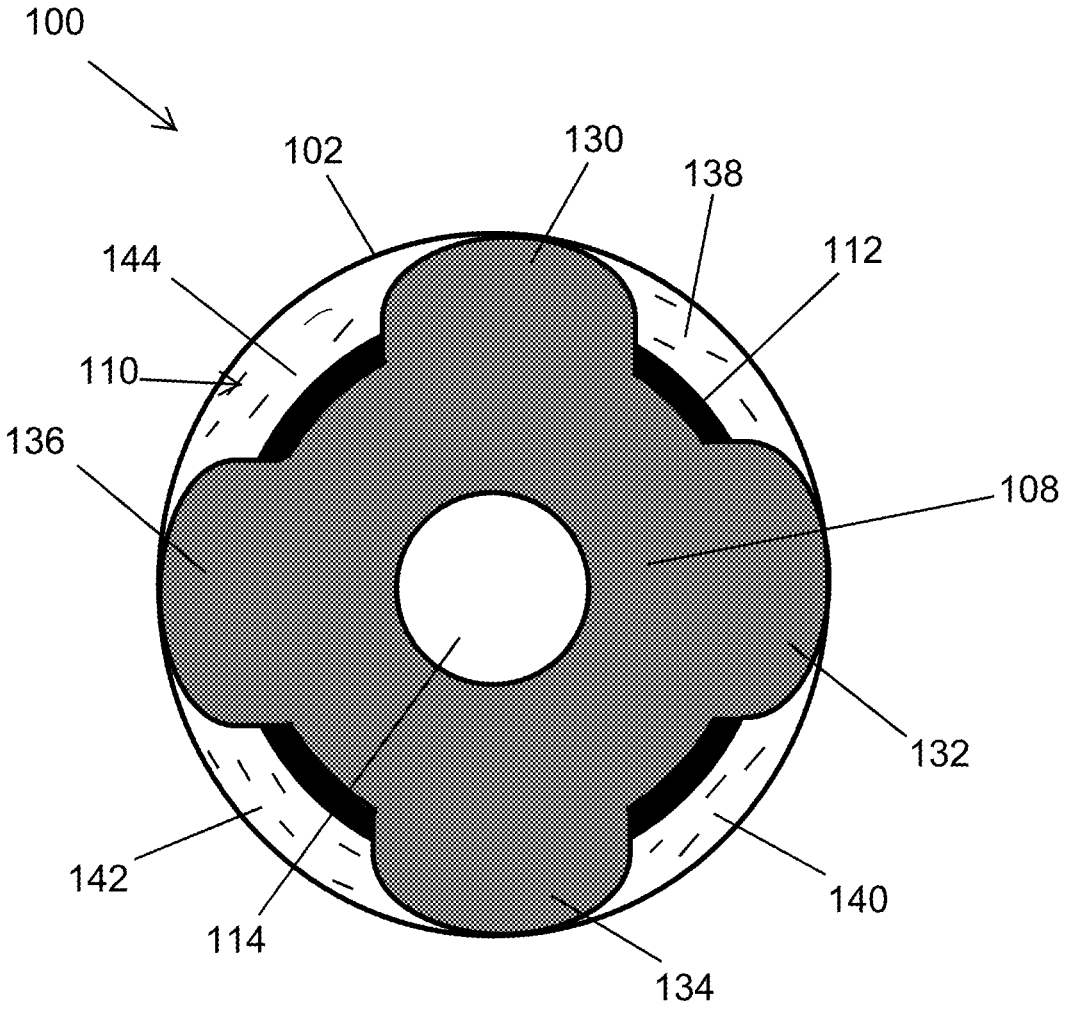
FIG. 1B illustrates an end-side internal view of the liquid slug protection device of FIG. 1A according to an example embodiment.
Figure 2:
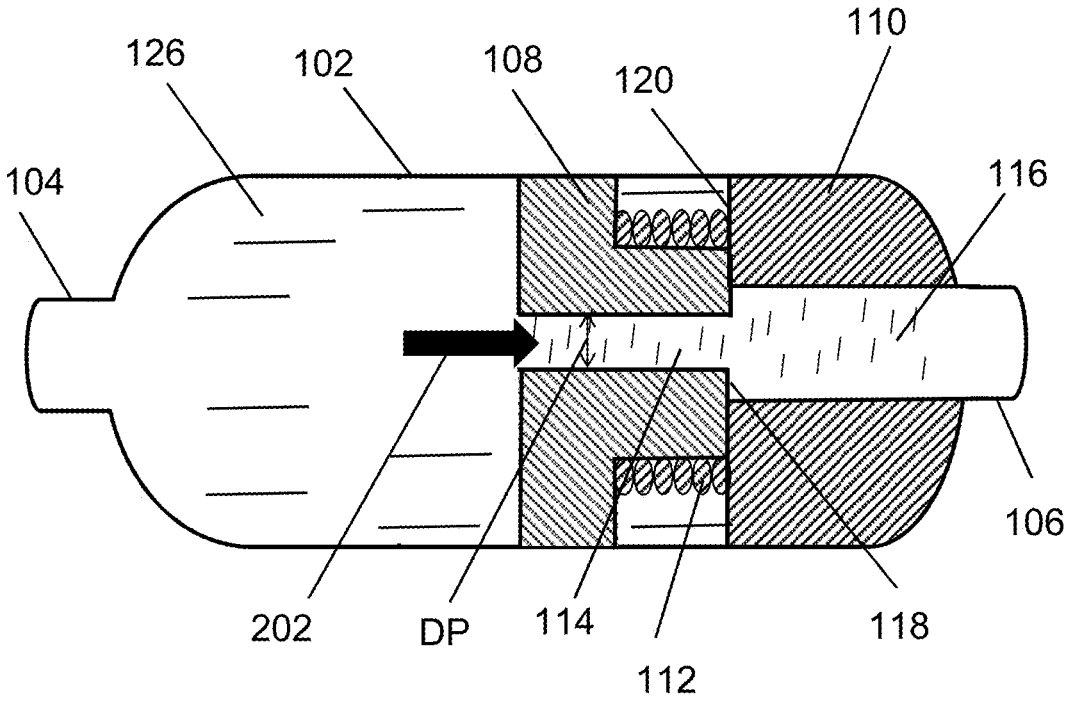
FIG. 2 illustrates a cross-sectional view of the liquid slug protection device of FIG. 1A with a piston in a closed position according to an example embodiment.

Turning now to the figures, particular example embodiments are described. FIG. 1A illustrates a cross-sectional view of a liquid slug protection device 100 according to an example embodiment. FIG. 1B illustrates an end-side internal view of the liquid slug protection device 100 of FIG. 1A according to an example embodiment. FIG. 2 illustrates a cross-sectional view of the liquid slug protection device of FIG. 1A with a piston in a closed position according to an example embodiment. The liquid slug protection device 100 can be installed in a refrigerant line of air conditioning systems and heat pump systems before the suction line connection of a compressor to reduce the amount of refrigerant that reaches the compressor in a liquid form.

Referring to FIGS. 1A, 1B, and 2, in some example embodiments, the device 100 includes a housing 102 that has an inlet port 104 and an outlet port 106. A refrigerant can enter the housing 102 through the inlet port 104 and exit the housing 102 through the outlet port 106. The inlet port 104 may have an inner diameter DI, and the outlet port 106 may have an inner diameter DO. For example, the inlet port 104 and the outlet port 106 may be sized for attachment (e.g., by soldering) to suction line pipes that are typically used air conditioning and heat pump systems.

In some example embodiments, the device 100 includes a piston 108, a backing structure 110, and a spring 112 that are disposed in a cavity 126 of the housing 102. The backing structure 110 may be positioned proximal to the outlet port 106 and may be fixedly attached to the housing 102. The piston 108 may move toward and away from the backing structure 110 depending on the pressure exerted on the piston 108 by a refrigerant in the cavity 126. For example, the piston 108 may be movable toward the backing structure 110 until the piston 108 abuts against the backing structure 110. A surface 118 of the piston 108 may be in contact with the surface 120 of the backing structure 110 when the piston 108 is abutted against the backing structure 110.

In some example embodiments, the spring 112 may be positioned annularly around a shaft portion of the piston 108. The spring 112 may be secured to the piston 108 to prevent the spring 112 from falling of the piston 108. For example, a winding of the spring 112 distal from the backing structure 110 may be soldered to the piston 108. A portion of the spring 112 may extend across the space separating the piston 108 and the backing structure 110. The spring 112 may be positioned such that a movement of the piston 108 toward the backing structure 110 can result in the compression of the spring 112 and a movement of the piston 108 away from the backing structure 110 can result in the decompression of the spring 112. The spring 112, when compressed, exerts a reactive force on the piston 108 that pushes the piston 108 away from the backing structure 110.

In some example embodiments, the piston 108 has an inflow channel 114 that extends through the piston 108, and the backing structure 110 has an outflow channel 116 that extends through the backing structure 110. A refrigerant flow path from the inlet port 104 to the outlet port 106 may include the inflow channel 114 and the outflow channel 116. To illustrate, at least a portion of a refrigerant that enters the housing 102 through the inlet port 104 may flow into the inflow channel 114, as illustrated by the arrow 122, and through the outflow channel 116 and may exit the device 100 through the outlet port 106. The refrigerant flow path through the inflow channel 114 is open when the piston 108 is separated/spaced from the backing structure 110 as well as when the piston 108 abuts against the backing structure 110

In some example embodiments, the device 100 includes peripheral channels 138-144, as more clearly illustrated in FIG. 1B. The peripheral channels 138-144 may be at least partially bound by the piston 108. For example, each one of the peripheral channels 138-144 may be at least partially bound by two adjacent protrusions from among protrusions 130-136. The peripheral channels 138-144 may also be bound by the piston 108 and a wall of the housing 102. In some example embodiments, the inflow channel 114 and the peripheral channels 138-144 may be sized to support the flow rate capacity of a suction line of an air conditioning system or a heat pump system with minimal effect on the normal refrigerant flow through the system. In some example embodiments, the inflow channel 114 may be aligned with the outflow channel 114 as illustrated in FIG. 1.

In some example embodiments, refrigerant flow paths from the inlet port 104 to the outlet port 106 include the peripheral channels 138-144 and the outflow channel 116. The refrigerant flow paths through the peripheral channels 138-144 may be open or closed depending on the position of the piston 108 relative to the backing structure 110. When the refrigerant flow paths through the peripheral channels 138-144 are open, at least a portion of a refrigerant that enters the housing 102 through the inlet port 104 may flow through the peripheral channels 138-144, as illustrated by the arrows 124, and through the outflow channel 116 and may exit the device 100 through the outlet port 106. The refrigerant flow paths through the peripheral channels 138-144 become closed when the piston 108 abuts against the backing structure 110 as illustrated in FIG. 2.

In some example embodiments, the inflow channel 114 through the piston 108 may be narrower than the inlet port 104. For example, the diameter DP of the inflow channel 114 may be smaller than the inner diameter DI of the inlet port 104. The diameter DP of the inflow channel 114 may also be smaller than the inner diameter DB of the outflow channel 116 of the backing structure 110. For example, the diameter DB of the outflow channel 116 may be approximately the same size as the inner diameter DO of the outlet port 106. To illustrate, the outflow channel 116 may have the same flow rate capacity as the inlet port 104 and the outlet port 106.

During operation, the refrigerant that enters the housing 102 through the inlet port 104 may use the refrigerant flow path through the inflow channel 114 and the refrigerant flow paths through the peripheral channels 138-144 to flow through the device 100. To illustrate, when the refrigerant is entirely in vapor form, the piston 108 may be separated from the backing structure 110 and may be in the position or a similar position as shown in FIG. 1A. When a portion of the refrigerant is in a liquid form, the refrigerant may exert a pressure on the piston 108, such as on a surface 128 of the piston 108, such that the piston 108 moves toward the backing structure 110 and becomes abutted against the backing structure 110.

Because the refrigerant flow paths through the peripheral channels 138-144 are closed when the piston is abutted against the backing structure 110 as illustrated in FIG. 2, the refrigerant is limited to the flow path that includes the inflow channel 114 of the piston 108 and the outflow path 116 of the backing structure 100 as indicated by the arrow 202. Because the inflow channel 114 is narrower than the inlet port 104, a difference in pressure exists across the inflow channel 114 between the side of the inlet port 104 and the side of the outlet port 106. The difference in the pressure across the inflow channel 114 may result in the liquid portion of the refrigerant received by the device 100 vaporizing before reaching the outlet port 106 such that the refrigerant exiting the device 100 through the outlet port 106 is in vapor form.

When the liquid portion of the refrigerant entering the housing 102 through the inlet port 104 becomes too low to keep the piston 108 abutted against the backing structure 110, the spring 112, which was compressed by the piston 108, pushes back the piston 108, thereby opening the refrigerant flow paths to the outlet port 106 through the peripheral channels 138-144.

In some example embodiments, the device 100 including the housing 102, the piston 108, the backing structure 110, and the spring 112 may be made from copper, brass, another material, or a combination of two or more thereof. For example, the housing 102 may be a spun copper housing. Backing structure 110 may be made from brass or copper. Methods such as spinning, cutting, milling, soldering, etc. may be used to make the device 100. For example, the device 110 may be made using similar methods and materials as those used in the manufacture of driers used in air conditioning and heat pump systems. The sizes of the housing 102, the piston 108, the backing structure 110, and the channels 114, 116, 138-144 may depend on the capacity of the air conditioning or heat pump system in which the device 100 is used.

By vaporizing the liquid portion of a refrigerant, the device 100 can reduce the amount of liquid refrigerant that reaches a compressor of an air conditioning or heat pump system. In contrast to a suction accumulator that relies on a relatively small orifice to meter out accumulated refrigerant to a compressor, the device 100 does not rely on accumulating the liquid refrigerant for slow transfer to the compressor. Instead, the device 100 can quickly vaporize the liquid refrigerant as received and provide a refrigerant to a compressor in vapor form. By eliminating or reducing the amount of liquid refrigerant that reaches the compressor, the device 100 may reduce the risk of damage to a compressor.

In some example embodiments, the device 100 may have fewer or more than four peripheral channels. For example, the device 100 may have just one peripheral channel that is used in a similar manner as described with respect to the peripheral channels 138-144. In some example embodiments, the piston 100 may have fewer or more than four protrusions that partially bound the peripheral channels. In some example embodiments, the inside of the piston 108 may be hollow or solid. In some example embodiments, the inside of the backing structure 110 may be hollow or solid. In some example embodiments, the device 100 may include a different kind of spring than shown without departing from the scope of this disclosure. In some example embodiments, the spring 112 or another spring may be in the housing 102 in a different position than shown without departing from the scope of this disclosure. In some alternative embodiments, the housing 102, the piston 108, the backing structure 110, the channels 114, 116, and 138-144 may each have a different shape than shown without departing from the scope of this disclosure.

Figure 3:
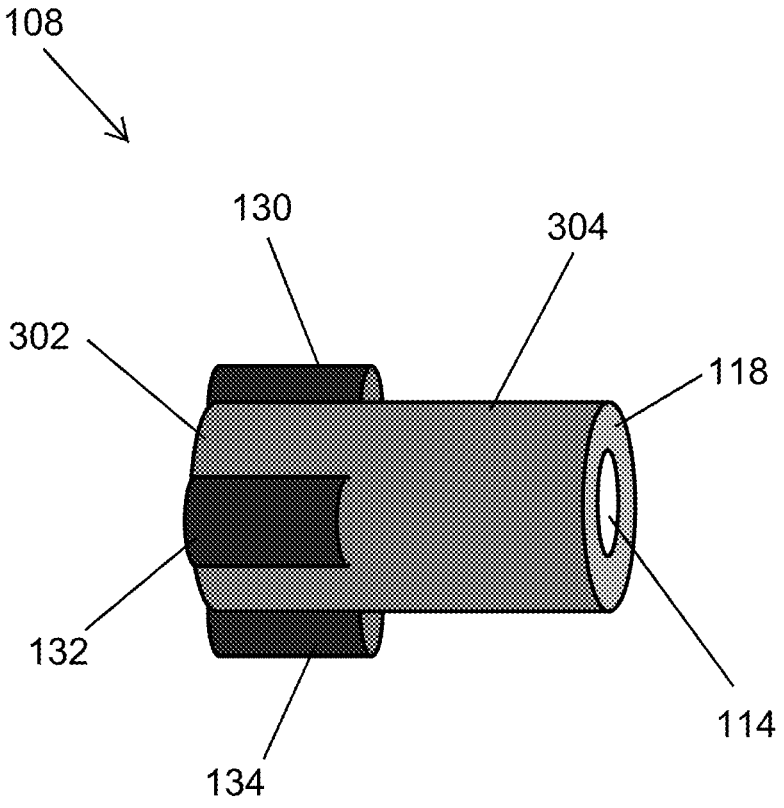
FIG. 3 illustrates a perspective view of a piston of the liquid slug protection device of FIG. 1A according to an example embodiment.
Figure 4:
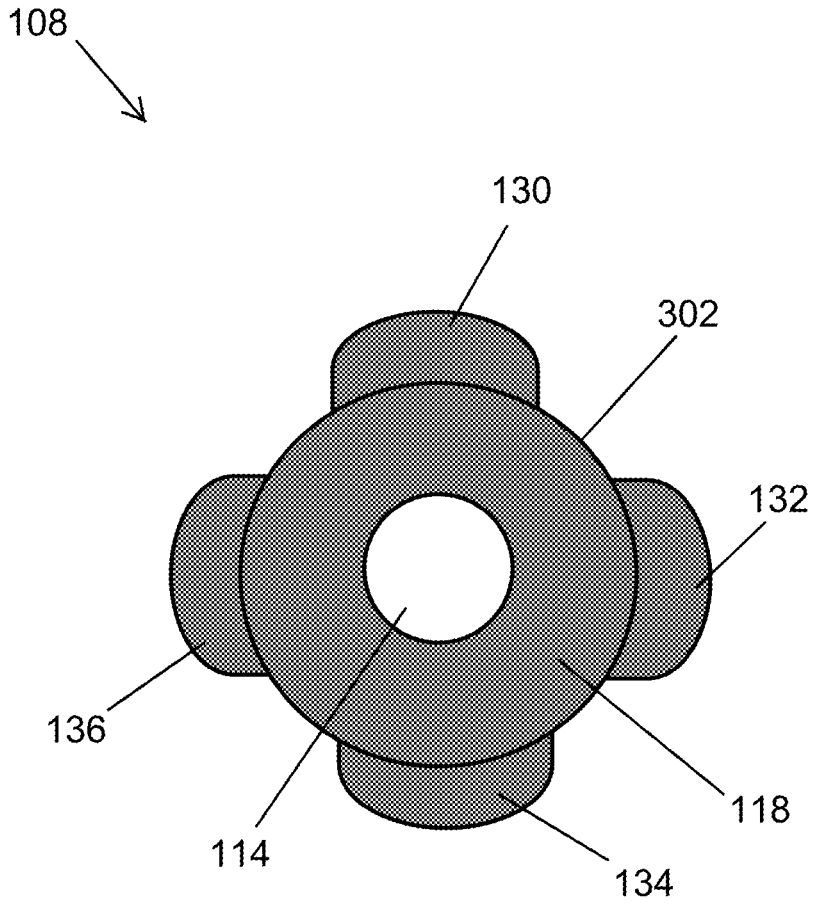
FIG. 4 illustrates an end view of the piston of FIG. 3 according to an example embodiment.

FIG. 3 illustrates a perspective view of the piston 108 of the liquid slug protection device 100 of FIG. 1A according to an example embodiment. FIG. 4 illustrates an end view of the piston 108 of FIG. 3 according to an example embodiment. Referring to FIGS. 1A-4, in some example embodiments, the piston 108 includes a shaft 302 and protrusions 130, 132, 134, 136. The spring 112 may be annularly positioned around a front portion 304 of the shaft 302. The inflow channel 114 is formed through the shaft 302 and extends for the entire length of the shaft 302.

In some example embodiments, the protrusions 130-136 may be sized such that the radially outermost portions of the protrusions 130-136 are in contact with or close to the wall of the housing 102 to limit the flow of refrigerant to the peripheral channels 138-144. The protrusions 130-136 may have curved perimeters that match the curvature of the housing 102. The protrusions 130-136 may be shaped to facilitate lateral movements of the piston 108 relative to the backing structure 110.

In some example embodiments, the piston 108 may be made from brass or from another suitable material. For example, the piston 108 may be made using methods such as casting, milling, cutting, etc.

Although the protrusions 130-136 are shown equally spaced from each other, in some alternative embodiments, the protrusions 130-136 may have different separations from each other. In some example embodiments, the piston 108 may have fewer or more than four protrusions 130-136 without departing from the scope of this disclosure. In some alternative embodiments, the piston 108 may have a different shape than shown without departing from the scope of this disclosure. For example, one or more of the protrusions 130-136 may have a different shape than shown. As another example, one or more of the protrusions 130-136 may extend along the shaft 302 less or more than shown.

Figure 5:
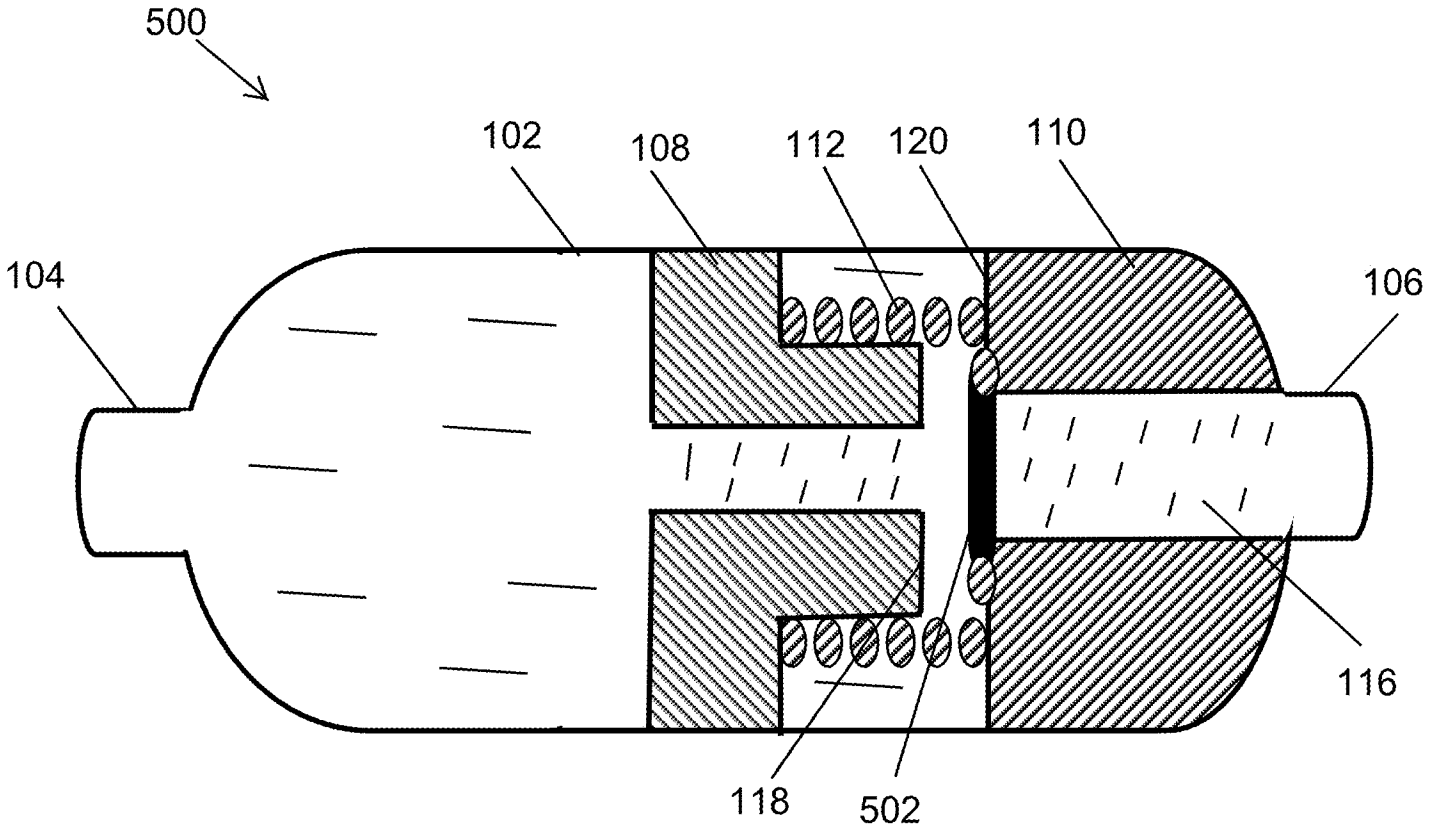
FIG. 5 illustrates a cross-sectional view of a liquid slug protection device according to another example embodiment.

FIG. 5 illustrates a cross-sectional view of a liquid slug protection device 500 according to another example embodiment.

The liquid slug protection device 500 is substantially similar to the liquid slug protection device 100 of FIG. 1A and operates in a substantially the same manner. To illustrate, the device 500 includes the housing 102, the piston 108, the backing structure 110, and the spring 112. In contrast to the device 100, the device 500 includes an O-ring gasket 502 that is positioned between the piston 108 and the backing structure 110. For example, the O-ring gasket 502 may be securely attached to the backing structure 110 in the position shown in FIG. 5. The O-ring 502 may be seated in a groove formed in the backing structure 110 or may be securely attached to the backing structure 110 by other means as can be contemplated by those of ordinary skill in the art with the benefit of this disclosure. In some alternative embodiments, the O-ring gasket 502 may be securely attached to the piston 108.

In some example embodiments, the O-ring gasket 502 may provide a seal between the surface 118 of the piston 108 and the surface 120 of the backing structure 110 when the piston 108 is pushed against the backing structure 110, for example, by a pressure exerted on the piston 108 by a refrigerant entering the housing 102 at least partially in a liquid form. The refrigerant flow paths from the inlet port 104 to the outlet port 106 through the peripheral channels 138-144 becomes closed when the piston 108 pushes against the O-ring gasket 502. When the refrigerant flow paths through the peripheral channels 138-144 device 500 is closed, the liquid refrigerant portion of the incoming refrigerant is vaporized and exits the device 500 through the outlet port 106 as described above with respect to the device 100.

Figure 6:
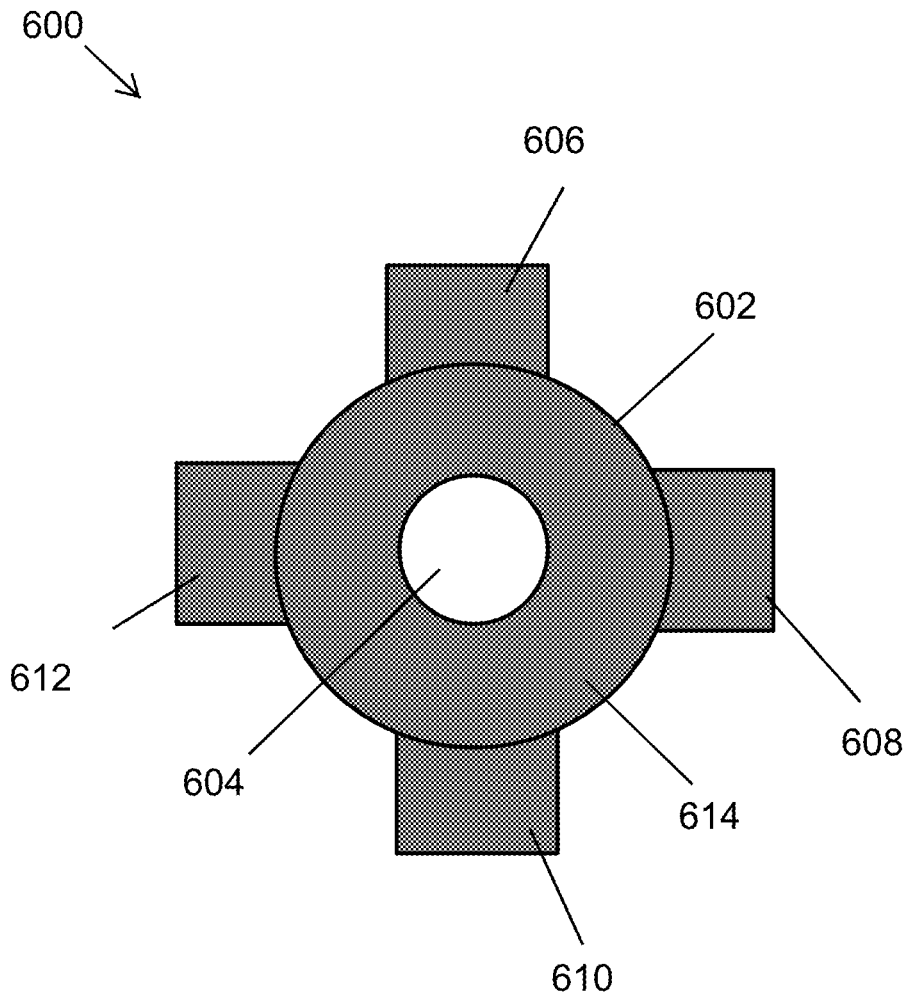
FIG. 6 illustrates an end view of a piston for use in the liquid slug protection devices of FIG. 1A and FIG. 5 according to another example embodiment.

FIG. 6 illustrates an end view of a piston for use in the liquid slug protection devices 100, 500 of FIG. 1A and FIG. 5 according to another example embodiment. In some example embodiments, the piston 600 includes a shaft 602 and protrusions 606-612. The protrusions 606-612 extend out from a portion of the shaft 602. The piston 600 also includes an inflow channel 604 that extends through the shaft 602 in a similar manner as the inflow channel 114 extends through the shaft 302 of the piston 108 of FIG. 3.

In some example embodiments, the piston 600 may be substantially similar to the piston 108 of FIG. 3 and may be used in the device 100 of FIG. 1 and in the device 500 of FIG. 5 in the same manner as described with respect to the piston 108. For example, the spring 112 of FIG. 1A may be annularly positioned around a front portion of the shaft 602. Peripheral channels, similar to the peripheral channels 138-144 more clearly shown in FIG. 1B, may be bound by adjacent protrusions of the protrusions 606-612. When the piston 600 is abutted against the backing structure 110, a front surface 614 of the piston 600 may come in contact with the surface 120 of the backing structure 110 in a similar manner as the surface 118 of the piston 108. In contrast to the piston 108, the protrusions 606-612 of the piston 600 may have a substantially flat outer perimeter instead of the curved outer perimeter of the protrusions 130-136 of the piston 108.

The piston 600 may be made from the same material and in a similar manner as the piston 108. For example, the piston 600 may be made from brass using methods such as casting, milling, cutting, etc.

Although the protrusions 606-612 are shown equally spaced from each other, in some alternative embodiments, the protrusions 606-612 may have different separations from each other. In some alternative embodiments, the piston 600 may include fewer or more than four protrusions without departing from the scope of this disclosure. In some alternative embodiments, the piston 600 may have a different shape than shown without departing from the scope of this disclosure. For example, one or more of the protrusions 606-612 may have a different shape than shown.

Figure 7:
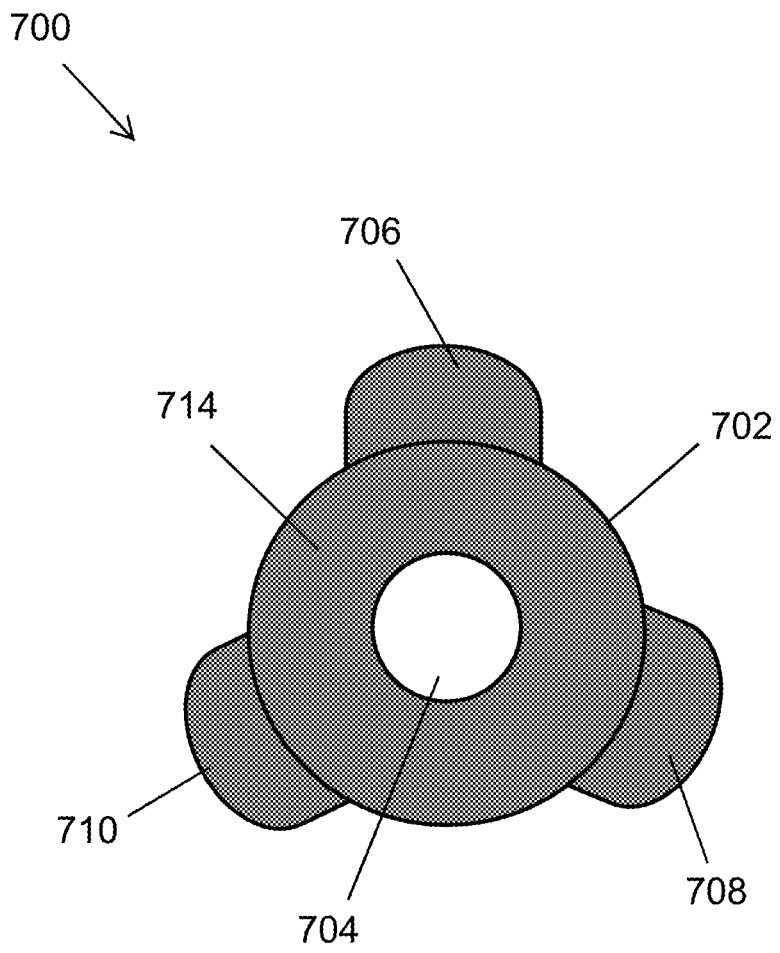
FIG. 7 illustrates an end view of a piston for use in the liquid slug protection devices of FIG. 1A and FIG. 5 according to another example embodiment.

FIG. 7 illustrates an end view of a piston for use in the liquid slug protection devices 100, 500 of FIG. 1A and FIG. 5 according to another example embodiment. In some example embodiments, the piston 700 includes a shaft 702 and protrusions 706-710. The protrusions 706-710 extend out from a portion of the shaft 702. The piston 700 also includes an inflow channel 704 that extends through the piston 702 in a similar manner as the inflow channel 114 extends through the shaft 302 of the piston 108 of FIG. 3.

In some example embodiments, the piston 700 may be substantially similar to the piston 108 of FIG. 3 and may be used in the device 100 of FIG. 1 and in the device 500 of FIG. 5 in the same manner as described with respect to the piston 108. For example, the spring 112 of FIG. 1A may be annularly positioned around a front portion of the shaft 702. Peripheral channels, similar to the peripheral channels 138-144 more clearly shown in FIG. 1B, may be bound by adjacent protrusions of the protrusions 706-710. When the piston 700 is abutted against the backing structure 110 of the device 100, a front surface 714 of the piston 700 may come in contact with the surface 120 of the backing structure 110 in a similar manner as the surface 118 of the piston 108. In contrast to the piston 108, the piston 600 includes the three protrusions 706-710 instead of the four protrusions 130-136 of the piston 108. The protrusions 706-710 may also be spaced differently than the protrusions 130-136 of the piston 108.

The piston 700 may be made from the same material and in a similar manner as the piston 108. For example, the piston 700 may be made from brass using methods such as casting, milling, cutting, etc.

Although the protrusions 706-710 are shown equally spaced from each other, in some alternative embodiments, the protrusions 706-710 may have different separations from each other. In some alternative embodiments, the piston 700 may include fewer or more than three protrusions without departing from the scope of this disclosure. In some alternative embodiments, the piston 700 may have a different shape than shown without departing from the scope of this disclosure. For example, one or more of the protrusions 706-710 may have a different shape than shown.

Figure 8:
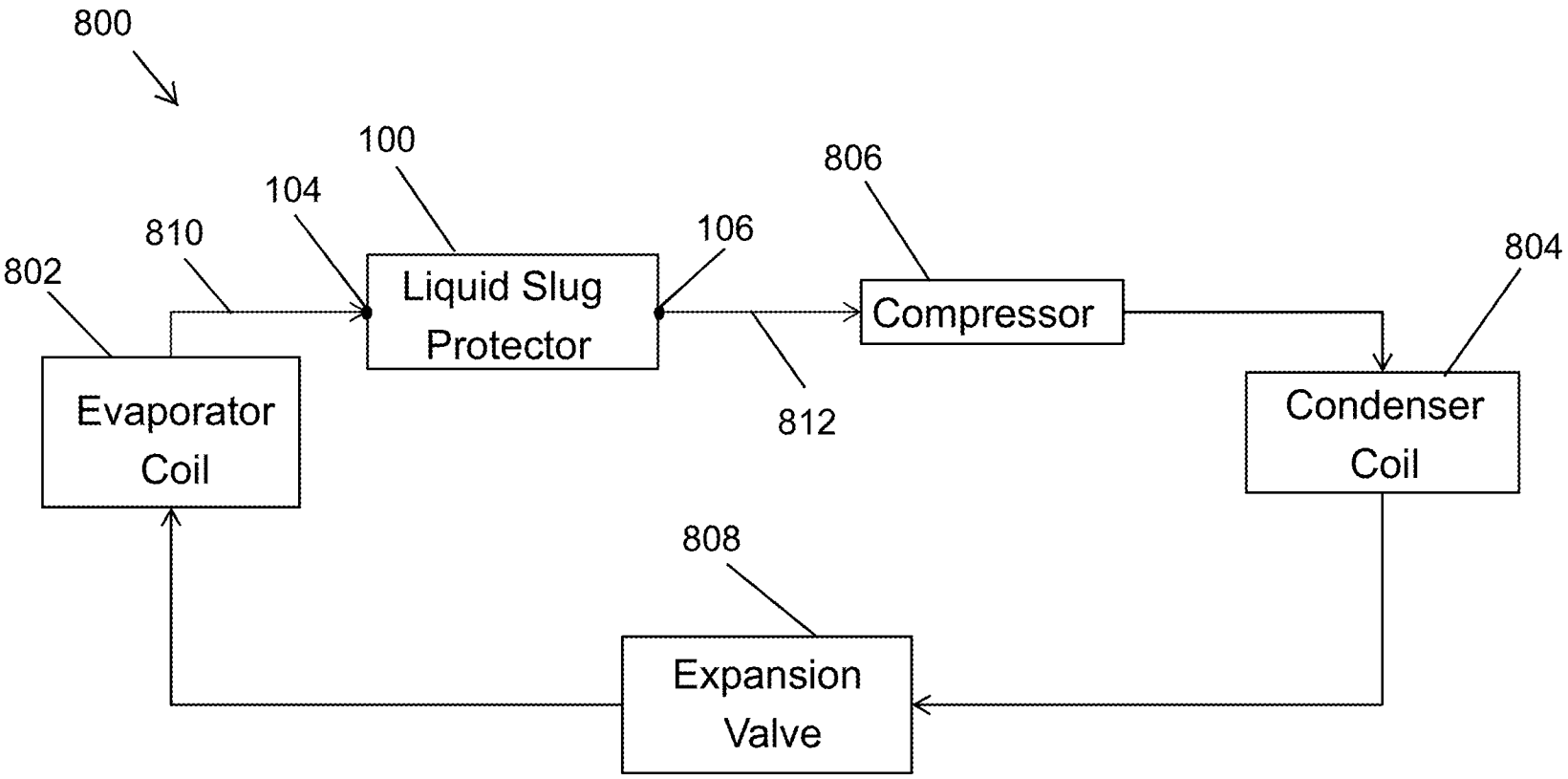
FIG. 8 illustrates an air conditioning system including the liquid slug protection device of FIG. 1A according to an example embodiment.

FIG. 8 illustrates an air conditioning system 800 including the liquid slug protection device 100 of FIG. 1A according to an example embodiment. Referring to FIGS. 1A and 8, in some example embodiments, the air conditioning system 800 includes an evaporator coil 802, a condenser coil 804, and a compressor 806. The system 800 may also include an expansion valve 808 in the refrigerant line between the condenser coil 804 and the evaporator coil 802, where the refrigerant used in the system 800 to cool an indoor space flows from the condenser coil 804 to the evaporator coil 802 through the expansion valve 808 as indicated by the arrows of the refrigerant lines of the system 800. In general, the evaporator coil 802 may be a standard indoor coil, and the condenser coil 804 may be a standard outdoor coil, where both of which are sized based on the overall capacity of the system 800.

In some example embodiments, the liquid slug protection device 100 is positioned between the evaporator coil 802 and the compressor 806. That is, the refrigerant exiting the evaporator coil 802 flows through the device 100 to reach the compressor 806. To illustrate, a refrigerant pipe 810 carrying a refrigerant from the evaporator coil 802 may be coupled to the inlet port 104 of the device 100. For example, the refrigerant received by the device 100 may be partially in liquid form. A refrigerant pipe 812 may be coupled to the outlet port 106 and may transport the refrigerant from the device 100 to the compressor 806. As described above with respect to FIGS. 1A, 1B and 2, the device 100 may vaporize liquid portion of the received refrigerant and provide the refrigerant to the compressor 806 in liquid form.

The use of the liquid slug protection device 100 in the air conditioning system 800 may reduce the risk of damage to the compressor 806 from liquid refrigerant slug reaching the compressor 806. Because the device 100 vaporizes the liquid portion of a refrigerant upon receiving the refrigerant, a technician or a consumer does not need to wait for vaporization or slow transfer of accumulated liquid refrigerant associated with conventional suction accumulators. In some example embodiments, the liquid slug protection device 100 may be used in place of a suction accumulator or along with a suction accumulator that is significantly smaller than would be required without the use of the device 100.

In some example embodiments, the system 800 may include components other than shown in FIG. 8 without departing from the scope of this disclosure. For example, the system 800 may include valve(s), filter(s), a drier(s), etc. in one or more of the refrigerant lines as can be readily understood by those of ordinary skill in the art with the benefit of this disclosure. In some example embodiments, the liquid slug protection device 500 of FIG. 5 may be used instead of the liquid slug protection device 100.

Figure 9:
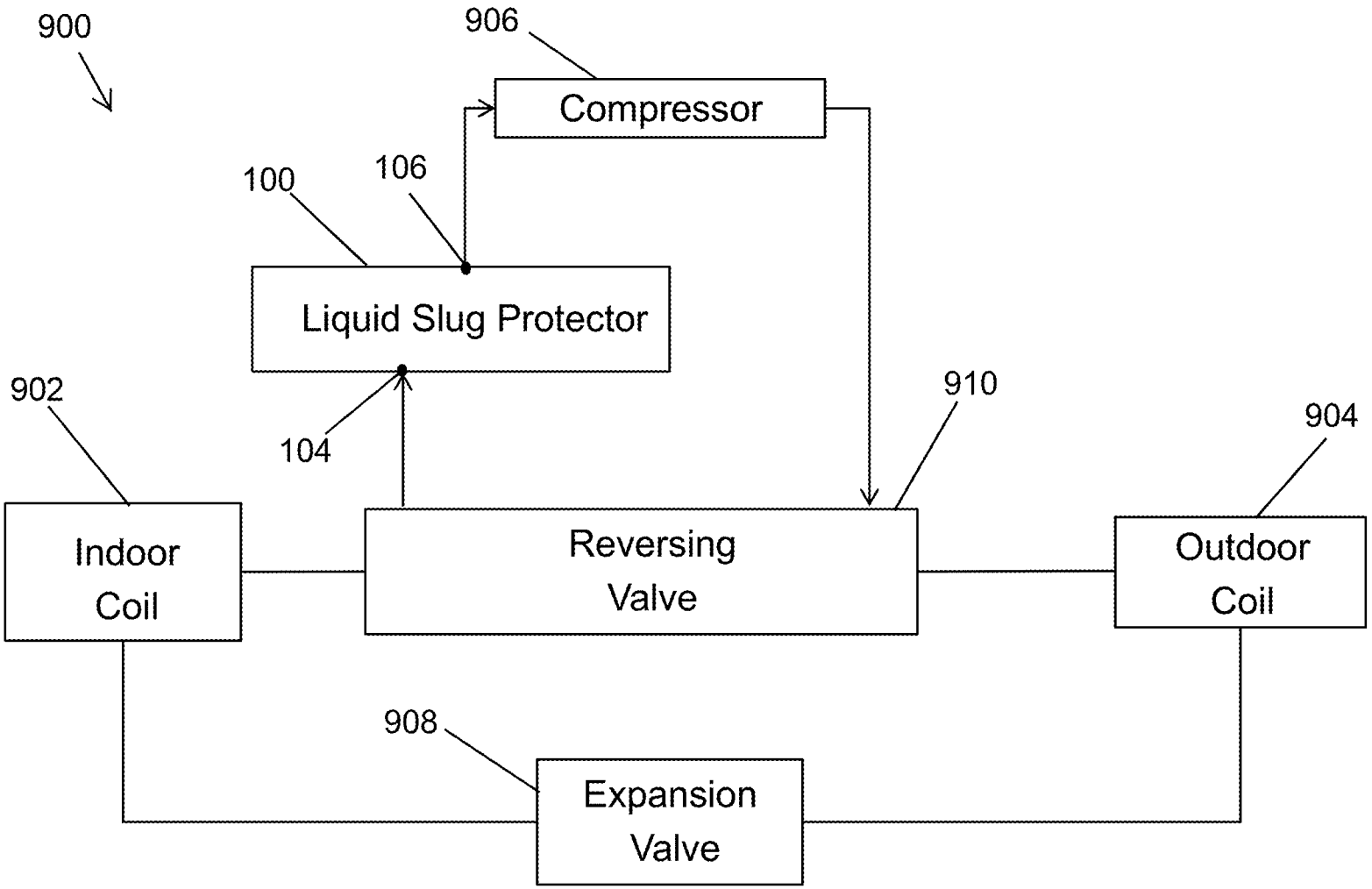
FIG. 9 illustrates a heat pump system including the liquid slug protection device of FIG. 1A according to an example embodiment.

FIG. 9 illustrates a heat pump system 900 including the liquid slug protection device 100 of FIG. 1A according to an example embodiment. Referring to FIGS. 1A and 9, in some example embodiments, the system 900 includes an indoor coil 902, an outdoor coil 904, a compressor 906, and an expansion valve 908. In some example embodiments, the system 900 may also include a reversing valve 910 that can be configured for a cooling operation or for a heating operation as can be readily understood by those of ordinary skill in the art with the benefit of this disclosure.

In some example embodiments, when the system 900 is configured to operate in a cooling mode, the system 900 operates in a similar manner as described above with respect to the air conditioning system 800 of FIG. 8. To illustrate, the indoor coil 902 may operate as an evaporator coil to cool down an indoor space, and the outdoor coil 904 may operate as a condenser coil to remove heat from the refrigerant circulating through the system 900.

In contrast, when the system 900 operates in a heating mode to heat an indoor space, the indoor coil 902 may operate as a condenser coil to remove from the refrigerant, and the outdoor coil 904 may operate as an evaporator coil. When operating in a heating mode, the reversing valve 910 allows the system 900 to operate in a similar manner as described with respect to the system 800, where the indoor coil 902 corresponds the condenser coil 804, and where the outdoor coil 904 corresponds to the evaporator coil 802.

The use of the liquid slug protection device 100 in the heat pump system 900 may reduce the risk of damage to the compressor 906 from liquid refrigerant slug reaching the compressor 906. Because the device 100 vaporizes the liquid portion of a refrigerant upon receiving the refrigerant, a technician or a consumer does not need to wait for vaporization or slow transfer of accumulated liquid refrigerant associated with conventional suction accumulators. In some example embodiments, the liquid slug protection device 100 may be used in place of a suction accumulator or along with a suction accumulator that is significantly smaller than would be required without the use of the device 100.

In some example embodiments, the system 900 may include components other than shown in FIG. 9 without departing from the scope of this disclosure. For example, the system 900 may include valve(s), filter(s), a drier(s), etc. in one or more of the refrigerant lines as can be readily understood by those of ordinary skill in the art with the benefit of this disclosure. In some example embodiments, the liquid slug protection device 500 of FIG. 5 may be used instead of the liquid slug protection device 100.

Although particular embodiments have been described herein in detail, the descriptions are by way of example. The features of the embodiments described herein are representative and, in alternative embodiments, certain features, elements, and/or steps may be added or omitted. Additionally, modifications to aspects of the embodiments described herein may be made by those skilled in the art without departing from the spirit and scope of the following claims, the scope of which are to be accorded the broadest interpretation so as to encompass modifications and equivalent structures.

What is claimed is:

1. A liquid slug protector device, the device comprising:
a housing having an inlet port, an outlet port, and a cavity;
a piston disposed in the cavity and comprising an inflow channel;
a backing structure disposed in the cavity between the piston and the outlet port and comprising an outflow channel, wherein a first refrigerant flow path from the inlet port to the outlet port includes the inflow channel and the outflow channel; and
a peripheral channel that is at least partially bound by the piston, wherein a second refrigerant flow path from the inlet port to the outlet port includes the peripheral channel and the outflow channel and wherein the second refrigerant flow path is closed when the piston abuts against an O-ring gasket that is positioned against the backing structure and between the piston and the backing structure.

2. The liquid slug protector device of claim 1, wherein the piston is moveable toward and away from the backing structure depending on pressure exerted on the piston by a refrigerant in the cavity and wherein the piston is movable toward the backing structure until the piston abuts against the O-ring gasket.

3. The liquid slug protector device of claim 1, wherein the first refrigerant flow path is open when the piston is spaced from the O-ring gasket and when the piston abuts against the O-ring gasket.

4. The liquid slug protector device of claim 1, further comprising a spring positioned in the cavity, wherein the piston compresses the spring toward the backing structure when the piston moves toward the backing structure.

5. The liquid slug protector device of claim 4, wherein the spring is positioned annularly around a shaft portion of the piston.

6. The liquid slug protector device of claim 1, wherein the inflow channel is narrower than the inlet port to allow a liquid portion of a refrigerant that enters the cavity through the inlet port to be vaporized when the piston abuts against the O-ring gasket.

7. The liquid slug protector device of claim 6, wherein the inflow channel is narrower than the outflow channel and the outlet port.

8. The liquid slug protector device of claim 1, wherein the peripheral channel is formed between the piston and a wall of the housing.

9. The liquid slug protector device of claim 1, wherein the backing structure is fixedly attached to the housing.

10. The liquid slug protector device of claim 1, further comprising a second peripheral channel that is at least partially bound by the piston, wherein a third refrigerant flow path from the inlet port to the outlet port includes the second peripheral channel and the outflow channel and wherein the third refrigerant flow path is closed when the piston is abutted against the O-ring gasket.

11. A liquid slug protector device, the device comprising:
a housing having an inlet port, an outlet port, and a cavity;
a piston disposed in the cavity, wherein the piston comprises a shaft portion that comprises an inflow channel therethrough;
a backing structure disposed in the cavity between the piston and the outlet port and comprising an outflow channel, wherein a first refrigerant flow path from the inlet port to the outlet port includes the inflow channel and the outflow channel; and a peripheral channel that is at least partially bound by the shaft portion and protrusions extending outwardly from the shaft portion, wherein a second refrigerant flow path from the inlet port to the outlet port includes the peripheral channel and the outflow channel and wherein the second refrigerant flow path is closed when the piston abuts against the backing structure.

12. The liquid slug protector device of claim 11, wherein the piston is moveable toward and away from the backing structure depending on pressure exerted on the piston by a refrigerant in the cavity and wherein the piston is movable toward the backing structure until the piston abuts against the backing structure.

13. The liquid slug protector device of claim 11, wherein the first refrigerant flow path is open when the piston is spaced from the backing structure and when the piston abuts against the backing structure.

14. The liquid slug protector device of claim 11, further comprising a spring positioned annularly around the shaft portion of the piston, wherein the protrusions compress the spring toward the backing structure when the piston moves toward the backing structure.

15. The liquid slug protector device of claim 11, wherein the inflow channel is narrower than the inlet port to allow a liquid portion of a refrigerant that enters the cavity through the inlet port to be vaporized when the second refrigerant flow path is closed.

16. The liquid slug protector device of claim 11, wherein the backing structure is fixedly attached to the housing.

17. An air conditioning system, comprising:

an evaporator coil;

a compressor; and a liquid slug protector device that is fluidly coupled to the evaporator coil and the compressor, wherein the liquid slug protector device comprises:

a housing having an inlet port, an outlet port, and a cavity;

a piston disposed in the cavity and comprising an inflow channel;

a backing structure disposed in the cavity between the piston and the outlet port and comprising an outflow channel, wherein a first refrigerant flow path from the inlet port to the outlet port includes the inflow channel and the outflow channel; and a peripheral channel that is at least partially bound by the piston, wherein a second refrigerant flow path from the inlet port to the outlet port includes the peripheral channel and the outflow channel and wherein the second refrigerant flow path is closed when the piston abuts against an O-ring gasket that is positioned against the backing structure and between the piston and the backing structure.

18. The air conditioning system of claim 17, wherein the piston is moveable toward and away from the backing structure depending on pressure exerted on the piston by a refrigerant in the cavity and wherein the piston is movable toward the backing structure until the piston abuts against the O-ring gasket.

19. The air conditioning system of claim 17, wherein the first refrigerant flow path is open when the piston is spaced from the O-ring gasket and when the piston abuts against the O-ring gasket.

20. The air conditioning system of claim 17, wherein the inflow channel is narrower than the inlet port to allow a liquid portion of the refrigerant that enters the cavity through the inlet port to be vaporized when the piston is abutted against the O-ring gasket.

* * * * *